United States Patent [19]

Kulpa

[11] 4,169,482

[45] Oct. 2, 1979

[54] FASTENER FOR A HAIR ROLLER

[75] Inventor: Walter J. Kulpa, Norwalk, Conn.

[73] Assignee: Remington Products, Inc., Bridgeport, Conn.

[21] Appl. No.: 741,920

[22] Filed: Nov. 15, 1976

[51] Int. Cl.[2] ..... A45D 2/00

[52] U.S. Cl. ..... 132/40; 229/41 B

[58] Field of Search ..... 132/40, 42, 39, 43 R, 132/37 A, 34; 229/41 B, 93

[56] References Cited

U.S. PATENT DOCUMENTS

| | | | |
|---|---|---|---|
| 1,545,771 | 7/1925 | Hout | 229/41 B |
| 2,226,178 | 12/1940 | Page | 229/41 B |
| 2,369,385 | 2/1945 | Carruth et al. | 229/41 B |
| 2,402,944 | 7/1946 | Braloff | 229/41 B |
| 2,884,932 | 5/1959 | Solomon | 132/42 R |
| 2,889,834 | 6/1959 | Anderson et al. | 132/43 R |
| 3,108,603 | 10/1963 | Mobberley | 132/34 R |
| 3,232,300 | 2/1966 | Fisher | 732/39 |
| 3,241,561 | 3/1966 | Richmond | 132/40 |
| 3,404,694 | 10/1968 | Hammel | 132/40 |

*Primary Examiner*—G. E. McNeill

*Attorney, Agent, or Firm*—Charles R. Miranda; Joseph S. Failla

[57] ABSTRACT

A hair roller is disclosed which is adapted to be expanded from a substantially flat configuration into a body having an elongated, cylindrically shaped configuration which is substantially resistant to bending and buckling. The hair roller comprises first and second generally planar shaped, flexible roller members which are hinge coupled along their edges. The roller members are deflectable into a body having a generally cylindrical configuration and a fastener means is provided for maintaining the configuration. The fastener means includes a fastener member which is hinge coupled to a first of the roller members and improved means integrally formed on the other roller member for engaging the fastener member.

5 Claims, 6 Drawing Figures

FASTENER FOR A HAIR ROLLER

BACKGROUND OF THE INVENTION

This invention relates to hair rollers and, more particularly, to an improved form of cylindrically shaped hair roller which may be stored flat.

In U.S. Pat. application Ser. No. 741,611 now U.S. Pat. No. 4,141,370 which is filed concurrently herewith and which is assigned to the assignee of this invention, there is disclosed an improved form of hair roller. The hair roller described in the copending application is resistant to bending and buckling and is formed by first and second, generally planar shaped, flexible roller members which are hinge coupled along edges of the members and are expandable into a body having a generally cylindrically shaped configuration.

The referred-to copending application describes a fastener means for maintaining the body in a cylindrically shaped configuration. The fastening means includes a fastener member hinged to one of the roller members. It is rotatable about its hinge for flattening the body into a planar configuration and upon expansion to a cylindrical body, is rotatable about its hinge to extend across an inner space of the cylindrically shaped body and engage the opposite roller member. Fastening engagement is accomplished by the use of a tab segment formed on the fastener member and a slotted aperture formed in the opposite roller member for receiving the tab segment. The hair roller is reusable and the tab which engages the slot is subject to wear. For this reason and because excessive force can be applied to the fastener member during expansion to a cylindrical body, the tab will at times fail to make engagement and the fastener member will travel past the slot and undesirably extend beyond a distal edge of the body.

Accordingly, it is an object of this invention to provide an improved fastener means for a hair roller of the type described.

Another object of the invention is to provide a fastener means which inhibits travel of the fastener member beyond a distal edge of the hair roller.

Another object of the invention is to provide an improved fastener means wherein the means for engaging the fastener are integrally formed in the fastener member.

SUMMARY OF THE INVENTION

A hair roller adapted to be expanded from a substantially flat configuration into a body having an elongated, cylindrically shaped configuration which is substantially resistant to bending and buckling comprises first and second generally planar shaped, flexible roller members which are hinge coupled along their edges. These members are resiliently deflectable into a body having the desired generally cylindrically shaped configuration. A fastening means is provided which comprises a fastener member, means for providing a hinge coupling between the fastener member and the first roller member, and, a detenting engagement means positioned on the second roller member in the path of rotatable travel of the fastener member for establishing engagement between the fastener member and the second roller member. In accordance with more particular features of the invention, the detenting engagement means is adapted to inhibit travel of the fastener member beyond a distal edge of the hair roller.

BRIEF DESCRIPTION OF THE DRAWINGS

These and other objects and features of the invention will become apparent with reference to the following specification and the drawings wherein.

DETAILED DESCRIPTION

Figure 1:
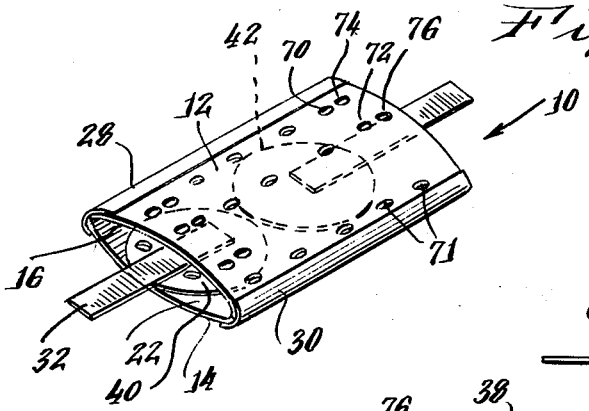
FIG. 1 is a perspective view of a hair roller constructed in accordance with features of this invention and which illustrates a hair roller in an undeflected, generally planar configuration for storage.
Figure 2:
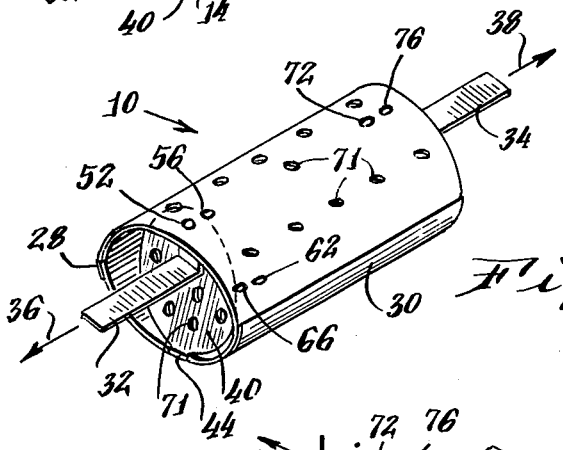
FIG. 2 is a perspective view of the hair roller of FIG. 1 illustrating the hair roller at an intermediate step in the process of expanding the hair roller to a body having a generally cylindrically shaped body configuration.
Figure 3:
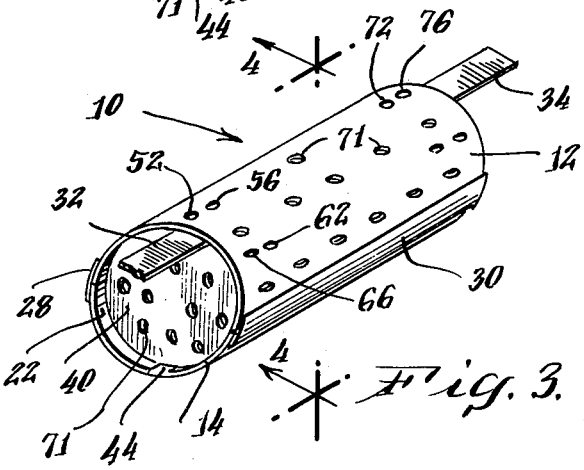
FIG. 3 is a perspective view illustrating the hair roller of FIG. 1 expanded into a body having a generally cylindrically shaped body configuration.

Referring now to the drawings, and particularly to FIGS. 1–3, a hair roller 10 is shown which is adapted to be expanded from a substantially flat configuration as illustrated in FIG. 1 into an elongated, cylindrically shaped body as illustrated in FIG. 3 which is substantially resistant to bending and buckling. The hair roller 10 comprises a first flexible, planar shaped roller member 12 and a second flexible, generally planar shaped roller member 14. The roller member 12 has a surface 16 (FIG. 5) with longitudinally extending first and second edges 18 and 20. The roller member 14 has a surface 22 and similarly has first and second longitudinally extending edges 24 and 26.

Figure 5:
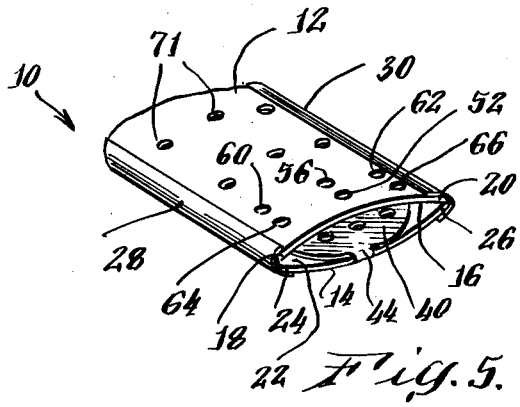
FIG. 5 is a fragmentary, perspective view of the hair roller of FIG. 4.

A means is provided for hinge coupling the edges of the first roller member 12 to the edges of the second roller member 14 whereby the surfaces 16 and 22 are positioned in juxtaposed relationship as illustrated in FIGS. 1 and 5. The hinging means comprises a first elongated adhesive strip 28 which is positioned against and adheres to edge segments of the members 12 and 14 and provides a flexible hinge between the edges 18 and 24. The hinging means also includes a second elongated adhesive strip 30 which is positioned adjacent to and adheres to edge segments of the members 12 and 14 and provides a hinge coupling between the edges 20 and 26. Alternatively, a hinging strip may be heat sealed to the roller members.

The hinged members 12 and 14 are formed of a material and have a thickness for providing a resilient deflectivity. While various materials can be utilized, a suitable material from which the members 12 and 14 are formed is a sheet of a polymer plastic such as polypropylene having a thickness in the range of about 0.010 inches to 0.015 inches (0.025 cm to 0.038 cm)

The hair roller 10 is expanded from the flat configuration of FIG. 1 to the cylindrical configuration of FIG. 3 by drawing on grips 32 and 34 in the direction indicated by the arrows 36 and 38 respectively. The grips are secured to disk shaped fastener members 40 and 42 which are rotated, as the grips 32 and 34 are drawn; contact the surfaces 16 and 22 of the members 12 and 14 respectively; and, cause their deflection into a generally cylindrical shaped configuration of FIG. 3.

Figure 4:
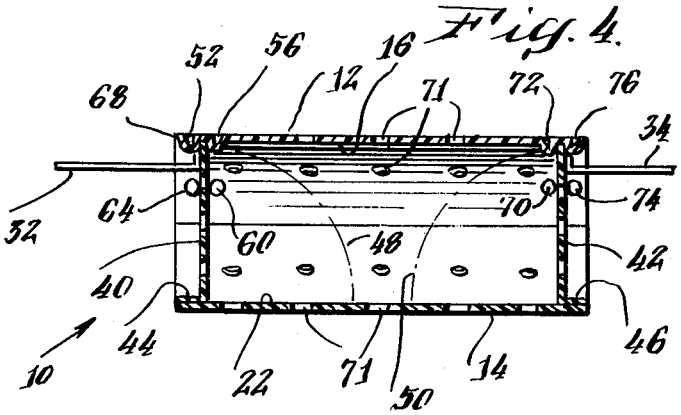
FIG. 4 is a sectional view taken along plane 4—4 of FIG. 3.

A fastening means is provided for maintaining the body of FIG. 3 in the generally cylindrically shaped configuration. The fastening means includes the disk shaped fastener members 40 and 42 which are hinged mounted to the surface 22 of the member 14 by segments 44 and 46 which, in one arrangement, are formed integrally with the fastener members 40 and 42 respectively and the member 14. The fastening means further includes a detenting engaging means which is integrally formed in the second member 12 in the paths 48 and 50 of the hinge rotatable fastener members 40 and 42 respectively. The detenting means which is shown in FIG. 4 comprises first and second integrally formed dimple segments 52 and 56 which engage the fastener member 40. By pulling the grip 32 as indicated by the arrow 36, the fastener member 40 will rotate in a counterclockwise direction as illustrated in FIG. 4, and, a slight resilient deformation will occur in the fastener member and in the body permitting the fastener to ride over the dimple 56 to an intermediate position at which location it is captivated between the dimples 52 and 56. Additional dimples having the same longitudinal location as the dimple 56 but which are spaced circumferentially about the member 12 are provided as illustrated by the dimples 60 and 62 (FIG. 5). Dimples are also spaced circumferentially in longitudinal alignment with the dimple 52 and comprise dimples 64 and 66 (FIG. 5). The dimples 52, 64 and 66 in addition to cooperating with the dimples 56, 60 and 62 for captivating the fastener member 40 also operate as a stop in the path of rotation 48 of the fastener member 40 and inhibit the member from traveling beyond a distal edge 68 of the hair roller.

The fastener member 42 similarly engages the member 12 and is captivated between dimples 70, 72 which are circumferentially spaced in longitudinal alignment and dimples 76 and 74 similarly circumferentially spaced and positioned in longitudinal alignment.

Figure 6:
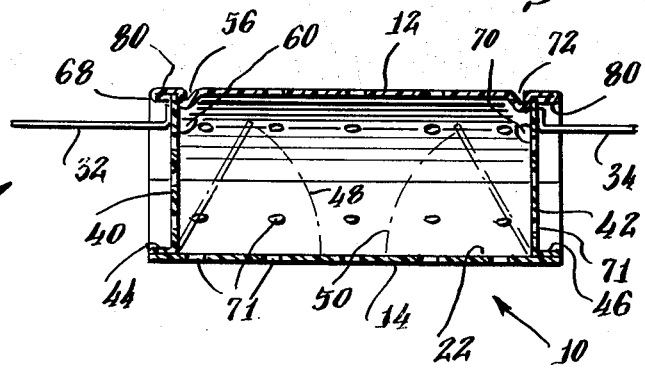
FIG. 6 is a sectional view of an alternative embodiment of the hair roller of FIGS. 1–4.

FIG. 6 illustrates an alternative arrangement wherein a stop is provided in the path of rotation of the fastener member 40 by a segment 80 of the distal edge 68 of the roller body. The edge 80 is flanged over, or is folded back as illustrated in FIG. 6, and in addition to forming a stop, cooperates with dimples 56 and 60 (FIG. 6) and 62 (FIG. 2) in providing captivating engagement between the fastener member 40 and the roller member 12. A similar fastener engaging arrangement for fastener member 42 is illustrated at the opposite end of the hair roller.

In order to enhance air flow through the hair roller and to enhance the application of hair treatment materials to hair wound on the roller, a plurality of appertures 71 are formed in the roller members 12 and 14, and, in the fastener members 40 and 42.

An improved hair roller has thus been described which utilizes an integrally formed fastener engaging means for engaging a fastener member of a hair roller.

While particular embodiments of the invention have been described, it will be appreciated by those skilled in the art that variations may be made thereto without departing from the spirit of the invention and the scope of the appended claims.

What is claimed is:

1. A hair roller resiliently expandable from a substantially flat storage configuration into an elongated generally cylindrical-shaped body which is substantially resistant to bending and buckling to externally applied finger force when readied for use, said hair roller comprising;

a. two resiliently flexible rectangular-shaped substantially flat body members having substantially the same width and the same length, b. each of said body members having opposed longitudinal marginal portions terminating in longitudinal edges, said body members being arranged in an overlying relationship with the longitudinal edges of one of said body members in an aligned coextensive relationship with corresponding longitudinal edges of the other of said body members, c. means secured to each of said opposed marginal portions in bridging relationship with said aligned longitudinal edges for hinge coupling said body members to each other forming a hinge coupled hair roller body having a substantially flat configuration, said hair roller body being resiliently deflectable to form a hair roller having a generally cylindrical-shaped configuration, d. a fastener member enclosed within the hair roller body and having opposed ends, one end of said fastener member being rotatably secured to one of said body members, the opposite end of said fastener member extending within said substantially flat hair roller body on a plane parallel to and between the overlying body members, said fastener member being operable for rotation within said hair roller body relative to said secured end for deflecting the hair roller body into said cylindrical-shaped configuration, e. detenting means integrally formed in said hair roller body in the path of travel of said fastener member, said fastener member being releasably engageable with said detenting means for maintaining said hair roller body in said deflected configuration, the resiliency of said hair roller body urging said hair roller into said substantially flat configuration upon release of said fastener member from said detenting means, and f. said detenting means including a dimpled segment formed in said other body member adjacent a distal end of the hair roller body, said dimpled segment having a surface portion projecting from the inner surface of said other body member in the path of travel of said fastener member, said fastener member and said hair roller body being resiliently deformed upon rotation of said fastener member into engagement with and past said surface portion of the dimpled segment, said detent means further including an outer segment of said other body member longitudinally spaced from said dimpled segment in the direction of said distal end in the path of travel of the fastener member, said dimpled segment and said outer segment captivating said fastener member therebetween and preventing rotation of the fastener member outward of the hair roller.

2. The hair roller of claim 1 wherein a second fastener member, a second dimpled segment and a second outer segment are provided, said second fastener member, said second dimpled segment and said second outer segment are arranged within the hair roller body adjacent an opposite distal end of said hair roller body in the same manner as the first mentioned fastener member, dimpled segment and outer segment.

3. The hair roller of claim 1 wherein said outer segment comprises a flanged over distal edge of the hair roller body positioned in the path of travel of said fastener member.

4. The hair roller of claim 1 wherein said outer segment comprises an outer dimpled segment having a surface portion projecting from the inner surface of said other body member.

5. The hair roller of claim 4 wherein said detenting means include a first plurality of dimpled segments having surface portions projecting from the inner surface of said other body member, said first plurality of dimpled segments being arranged in longitudinal alignment with the first mentioned dimpled segment and spaced circumferentially on the interior surface of said other body member, and wherein a second plurality of dimpled segments constructed in the same manner as said first plurality of dimpled segments are arranged in longitudinal alignment with said outer dimpled segment and spaced circumferentially on the interior surface of said other body member.

* * * * *